US011788270B1

(12) United States Patent
Massa

(10) Patent No.: US 11,788,270 B1
(45) Date of Patent: Oct. 17, 2023

(54) SELF-SUPPORTING VACUUM PLUMBING ASSEMBLY

(71) Applicant: Gabriel J. Massa, Neptune, NJ (US)

(72) Inventor: Gabriel J. Massa, Neptune, NJ (US)

( * ) Notice: Subject to any disclaimer, the term of this patent is extended or adjusted under 35 U.S.C. 154(b) by 0 days.

(21) Appl. No.: 17/525,033

(22) Filed: Nov. 12, 2021

Related U.S. Application Data

(60) Provisional application No. 63/271,409, filed on Oct. 25, 2021.

(51) Int. Cl.
*E03F 1/00* (2006.01)

(52) U.S. Cl.
CPC ..... *E03F 1/006* (2013.01)

(58) Field of Classification Search
CPC ..... E03F 1/006; E03C 1/1222; E03C 1/1227; C02F 2209/42
See application file for complete search history.

(56) References Cited

U.S. PATENT DOCUMENTS 2,419,319 A 4/1947 Fletcher
3,663,970 A * 5/1972 Drouhard, Jr. ..... E03F 1/006 4/319
3,746,032 A * 7/1973 Wallgren ..... C02F 1/006 137/205
4,210,528 A 7/1980 Coviello
4,691,731 A * 9/1987 Grooms ..... E03F 1/006 137/205
5,243,719 A 9/1993 McDonald
5,931,642 A * 8/1999 Friedman ..... E03F 1/006 417/36
5,971,303 A 10/1999 Pugh-Gottlieb
6,374,431 B1 * 4/2002 Dahlberg ..... E03F 1/006 4/321
6,837,258 B1 * 1/2005 Loreto ..... E03F 1/006 137/205
6,990,993 B2 1/2006 Hafner et al.
7,374,669 B2 5/2008 Zinn
8,110,097 B2 2/2012 Arai
10,352,028 B2 7/2019 Boeltl et al.
2011/0099918 A1 5/2011 Buchmann
2011/0226341 A1 9/2011 Platteel
2012/0226341 A1 9/2012 Knepp
2019/0003171 A1 1/2019 Lappalainen et al.
2019/0184435 A1 6/2019 Oltz et al.
(Continued)

FOREIGN PATENT DOCUMENTS

WO WO-0206594 A1 * 1/2002 ..... B64D 11/02

OTHER PUBLICATIONS

U.S. Appl. No. 29/748,700, filed Aug. 31, 2020, Thomas, et al.
(Continued)

*Primary Examiner* — Terry K Cecil
(74) *Attorney, Agent, or Firm* — JK Intellectual Property Law, PA

(57) ABSTRACT

A self-supporting vacuum plumbing assembly for attaching a plumbing fixture to a vacuum-assist waste removal system may include an accumulator associated with the plumbing fixture for receiving and holding wastewater from the plumbing fixture. A wastewater outlet conduit, an air intake conduit, and a sensor conduit are configured with the accumulator as a unit, the unit being substantially rigid sufficiently self-supporting to be transportable in a peripherally frameless configuration.

22 Claims, 11 Drawing Sheets

(56) References Cited

U.S. PATENT DOCUMENTS

| | | | |
|---|---|---|---|
| 2019/0203456 | A1 | 7/2019 | Lappalainen |
| 2021/0010248 | A1 | 1/2021 | Lyons |
| 2022/0056682 | A1 | 2/2022 | Massa et al. |
| 2022/0064915 | A1 | 3/2022 | Thomas et al. |

OTHER PUBLICATIONS

AcornVac Inc. brochure, "Clearing the Pipelines to Community-Based Care", dated Aug. 2019.
AcornVac, Inc. brochure, "A Versatile Engineered Plumbing and Waste Solution", dated Oct. 2010.
JETS "Piping Guide, Vacuum Piping Guide, Building", dated Jun. 6, 2018.

* cited by examiner

SELF-SUPPORTING VACUUM PLUMBING ASSEMBLY

CROSS-REFERENCE TO RELATED APPLICATIONS

This application claims benefit to U.S. Provisional Patent Application No. 63/271,409, dated Oct. 25, 2021, which is incorporated in its entirety by reference herein.

TECHNICAL FIELD

The present disclosure relates generally to self-supporting vacuum plumbing assemblies including accumulators that can be used to mount one or more plumbing fixtures in a desired location, as well as related systems and methods, all without requiring use of an external or peripheral frame to secure together the components of the assemblies that must be attached to the accumulators during transportation and handling, and/or during or after installation of the assemblies. The assemblies can be made self-supporting, for example, via use of rigid connections between the conduits (risers) and the accumulators within such systems, thereby eliminating the need for an external support frame, so that the combined construction is sufficiently rigid after manufacturing that the assemblies can be transported and installed in such form. The self-supporting construction of the assemblies has particular utility within modular and/or premanufactured wall systems, where only a narrow space may be available between wall surfaces, but the assemblies have utility within any type of interior or exterior wall or compartment of a building, or anywhere inside or outside of a building a plumbing connection and fixture are desired.

BACKGROUND

Various types of plumbing drainage systems are used to direct waste from one or more sources to a common collection point. For example, gravity feed systems are commonly used in residential and commercial buildings. In a gravity feed system, gravity provides the motive force to move the waste from the source(s) to the collection point. Because gravity is the main motive force, the pipes between the source(s) and the collection point must slope down toward the collection point to maintain the desired flow. The requirement that the pipes slope also requires careful design to assure that the pipes are properly located. For residential and commercial buildings where floors are formed of concrete slabs, particularly those with steel reinforced slabs, installation and reconfiguring of supply and draining piping can be difficult and/or limited by the slab structures.

Drainage systems using suction to draw waste from sources have been introduced to offer an alternative to gravity systems. These systems are commonly called vacuum plumbing systems, vacuum-assist wastewater systems, or the like. Such systems use a combination of gravity and suction (i.e., a pressure less than ambient atmosphere, but not strictly speaking vacuum per se) to draw waste from the source(s) to a collection point. Because the main motive force is suction rather than gravity, the orientation of the pipes need not be downwardly sloped as in gravity feed systems.

Often, plumbing and electrical connections used to connect plumbing fixtures to vacuum-assist plumbing systems are overhead (i.e., within or above ceilings, below overhead flooring, etc.). In such case, risers within the walls extend from the plumbing fixtures up to such connections to facilitate and protect liquid and electrical connections. While such systems work well, installation requires use of multiple professionals and tradespersons (i.e., MEP engineers or designers, plumbers, electricians, framers, drywallers, etc.) to design, assemble from many parts, and custom install each fixture and the riser connections in such systems. If designs are changed during construction or buildings are to be reconfigured later, an added level of complexity and cost is involved.

Fitting such systems within a wall can also be a challenge due to the minimal space available within typical site-built walls and in particular modular walls, which are often thinner in profile. Use of any external or peripheral supports, framing, etc., on such systems, including those disclosed in U.S. patent application Ser. No. 17/364,403, filed Jun. 30, 2021, necessarily adds bulk and/or weight, thereby interfering with use of such systems in walls, and complicates the assembly, handling, transport and/or installation of such systems. Therefore, a cost-effective, simplified, and effective self-supporting vacuum plumbing assembly for attaching a plumbing fixture to a vacuum-assist waste removal system and/or a water supply system, an installed assembly with plumbing fixture(s), a vacuum plumbing system, and method of installation and use, addressing one or more drawbacks of existing systems, or other needs, would be welcome.

SUMMARY

According to certain aspects of the disclosure, a self-supporting vacuum plumbing assembly for attaching a plumbing fixture to a vacuum-assist waste removal system may include an accumulator associated with the plumbing fixture for receiving and holding wastewater from the plumbing fixture, a wastewater inlet opening being defined in the accumulator for receiving the wastewater from the plumbing fixture. A wastewater outlet conduit has a first end rigidly attached to the accumulator and a second end configured for attachment to the vacuum-assist waste removal system, the wastewater outlet conduit being configured for directing wastewater from the accumulator to the vacuum-assist waste removal system. An air intake conduit has a first end rigidly attached to the accumulator and a second end spaced from the first end, the air intake conduit being configured for allowing flow of air into the accumulator through the air intake conduit when the vacuum-assist waste removal system is removing wastewater from the accumulator through the wastewater outlet conduit. A sensor conduit has a first end rigidly attached to the accumulator and a second end spaced from the first end, the sensor conduit configured for at least assisting in at least one of generating a signal and relaying a signal when a level of the wastewater in the accumulator reaches a predetermined level, the signal indicating that the vacuum-assist waste removal system should remove the wastewater from the accumulator by applying suction to the second end of the wastewater outlet conduit. The wastewater outlet conduit, the air intake conduit, and the sensor conduit are configured with the accumulator as a unit, the unit being substantially rigid sufficiently self-supporting to be transportable in a peripherally frameless configuration. Various options and modifications are possible.

For example, the accumulator may be a container having a bottom, sides, and a top defining an interior volume for holding the wastewater. Each of the wastewater outlet conduit, the air intake conduit, and the sensor conduit may communicate with the interior of the container through the top of the container.

The sensor conduit may be a tube extending into the interior volume of the container, the first end of the sensor conduit located at a height within the container so that when the wastewater in the container reaches the predetermined level the signal is generated. The signal may be generated by a pressure sensor after a level of the wastewater in the container rises to the height of and closes the first end of the sensor conduit. The pressure sensor may be located proximate the second end of the sensor conduit. The signal may be generated by a float sensor in the container after a level of the wastewater in the container rises to the predetermined level actuates the float sensor, and the float sensor may communicate with the vacuum-assist waste removal system via wiring extending through the sensor conduit.

A wastewater conduit may be in communication with the wastewater inlet opening, the wastewater conduit receiving wastewater from at least one fixture. The assembly may include two of the air intake conduits for providing flow of air into the accumulator during the suctioning of wastewater from the accumulator. At least one of the wastewater outlet conduit, the air intake conduit, and the sensor conduit may be attached directly to the accumulator. The at least one of the wastewater outlet conduit, the air intake conduit, and the sensor conduit may be attached to the accumulator by at least one of welding, gluing, threading, and clamping. At least one sleeve may be fixedly attached to the accumulator, and wherein one of the wastewater outlet conduit, the air intake conduit, and the sensor conduit extends at least into the sleeve and is attached thereto. The one of the wastewater outlet conduit, the air intake conduit, and the sensor conduit may extend through the sleeve and is attached to the sleeve by at least one of welding, gluing, threading, and clamping. A plurality of the sleeves may be provided, and wherein each of the wastewater outlet conduit, the air intake conduit, and the sensor conduit is attached to a respective one of the sleeves.

The accumulator may have a width of no more than 2⅞ inches. Also, the accumulator may have a width of about 2¼ inches. At least one of the wastewater outlet conduit, the air intake conduit, and the sensor conduit may include a pipe made of a pipe having a 1½ inch outer diameter. The pipe may be made of one of PVC, stainless steel, lead, or cast iron.

The disclosure is also related to a plumbing fixture installation comprising the self-supporting vacuum plumbing assembly as above and further including the plumbing fixture, the plumbing fixture having an outlet communicatively attached to the wastewater inlet opening of the accumulator so that wastewater from the plumbing fixture is transmitted to the accumulator. If so, a wall may be provided having at least one wall surface, the fixture being mounted on one side of the wall surface and the self-supporting vacuum plumbing assembly being mounted on an opposite side of the wall surface. Also, the wall may have two wall surfaces defining a cavity therebetween, the fixture being mounted on an outer side of one of the wall surfaces and the self-supporting vacuum plumbing assembly being mounted in the cavity between the two wall surfaces. The wall may be a modular wall, the modular wall being a prefabricated structure. The cavity may have a width between the two wall surfaces of no greater than 2⅞ inches. Also, the assembly may have a width of from ¼ to ½ inches less than the width of the cavity so that the assembly fits within the cavity.

The installation may further include a water supply for supplying water to the fixture. The water supply may include a hot water conduit and a cold water conduit. The installation may further include a wiring conduit attached to the wall, the wiring conduit having a first end proximate an attachment location of the plumbing fixture and a second end configured for attachment to wiring of the vacuum-assist waste removal system, and the installation may also include the wiring within the wiring conduit, the wiring within the wiring conduit including wiring for at least one of providing electrical power and providing electrical signaling. The installation may also include at least one of an electrical connector and at least one signaling device connected to the wiring and accessible from the one side of the wall on which the fixture is located. A bottom of the container may be configured for engagement with a lower surface of the cavity within the modular wall. At least one brace may be provided for mounting at least one additional item to at least one of the assembly and the wall, the additional item including one of a water supply and a wiring conduit.

In some aspects, the installation may further include the vacuum-assist waste removal system, and may also further including the water supply for supplying water to the fixture.

BRIEF DESCRIPTION OF THE DRAWINGS

More details of the present disclosure are set forth in the drawings.

DETAILED DESCRIPTION

Figure 1:
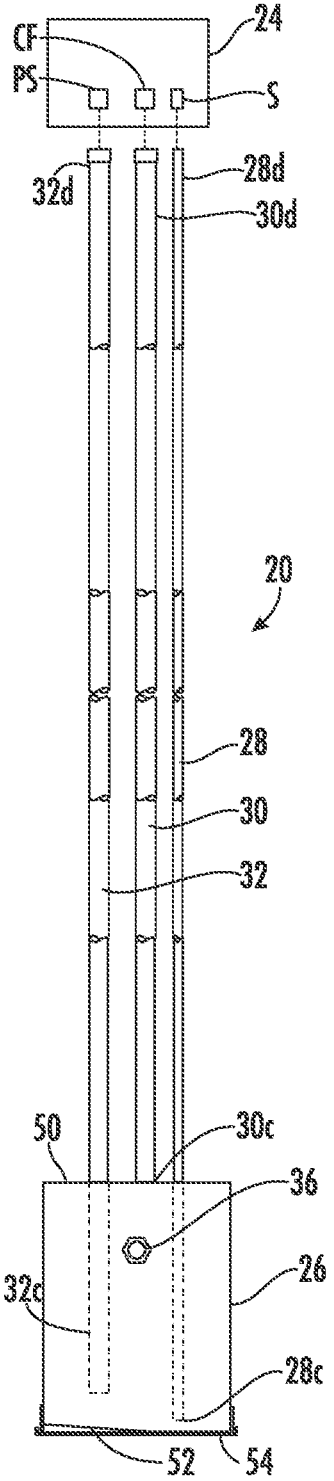
FIG. 1 is a front view of a self-supporting vacuum plumbing assembly for attaching a plumbing fixture to a vacuum-assist waste removal system according to one embodiment, with direct attachment of conduits to the accumulator.

Detailed reference will now be made to the drawings in which examples embodying the present disclosure are shown. The detailed description uses numeral and letter designations to refer to features in the drawings. Like or similar reference numerals in the drawings and description have been used to refer to like or similar parts of the disclosure.

The drawings and detailed description provide a full and enabling description of the disclosure and the manner and process of making and using it. Each embodiment is provided by way of explanation of the subject matter not limitation thereof. In fact, it will be apparent to those skilled in the art that various modifications and variations may be made to the disclosed subject matter without departing from the scope or spirit of the disclosure. For instance, features illustrated or described as part of one embodiment may be used with another embodiment to yield a still further embodiment.

FIGS. 1-19 show generally schematic views of assemblies useful to attach fixtures to a plumbing system, which may include a water supply system, and a vacuum-assist waste removal system. The Figures depict assemblies and systems that can be mounted in or along a wall of a building between a floor and an overhead structure such as a ceiling where conventional supply and vacuum waste removal connections may be located. The supply systems may be conventional hot or cold water supplies, with tanked or on-demand hot water, and may also include gasses (e.g., "medgas") or other non-water supplies, for example for medical or dental applications. The removal system may include any conventional suction powered waste removal system, electronic controls, etc., such as the types available from companies such as AcornVac or others. One skilled in the art can readily select the type and size of removal system required depending on the use and layout of the building into which it is to be placed. Electrical connections may be provided in other conduits or otherwise to sinks, toilets, or other specialized fixtures, for example, for signaling, fixture powering, or lighting.

It should be understood that the building in which such structures are located can be any type, including commercial, residential, institutional, medical, single-story, multi-story, new construction, retrofit or remodel, stick built, modular, or prefabricated, enclosed, indoor/outdoor, or outdoor shelter, built on a slab, built on a raised foundation or over a basement or crawlspace, etc. Thus, no limitation should be placed on the types of buildings in which the disclosed plumbing assemblies can be used. Also, the assemblies may be used within interior walls, exterior walls, such as stick-built or pre-fabricated 2×4 or other sizes of lumber walls, within metal-framed walls, uninsulated walls or walls insulated for thermal and/or sound purposes, etc. Conventional 2×4 lumber walls would have a maximum interior width of 3.5 inches, due to sizing of the 2×4 pieces used. The assemblies herein have particular utility within pre-assembled modular walls, but the assemblies can be used within or against any pre-made or on-site assembled wall structures, or even apart from walls, and no limitation as to utility of the disclosed assemblies should be taken from the examples shown herein. Conventional modular walls, such as those available from KI or other companies, are often (by design) thinner than conventional stick-built walls, and may have an external width of 3.5 inches between opposite wall surfaces, depending on application, leaving even less space between walls for plumbing and electrical fixtures.

As shown in the figures, the disclosed example of a fixture is a sink. It should be understood that no limitation on plumbing fixtures is intended by the examples used herein. Plumbing fixtures may be any of those used in settings such as commercial, residential, medical, dental, manufacturing, institutional, stadiums, arenas, theaters, restaurants, bakeries, and other food preparation sites, laundromats, etc. For example, plumbing fixtures could be one or more of sinks, toilets, urinals, bidets, showers, water fountains, bottle fillers, hand and eyewash stations, dental air and water supply, faucets, spickets, home and commercial appliances or equipment, or others. Also, some plumbing fixtures may include more than one of the above, such as sink and toilet units used in institutions. Thus, no limitation should be taken on the type of plumbing fixture(s) that could be used with the assemblies disclosed herein.

Figure 18:
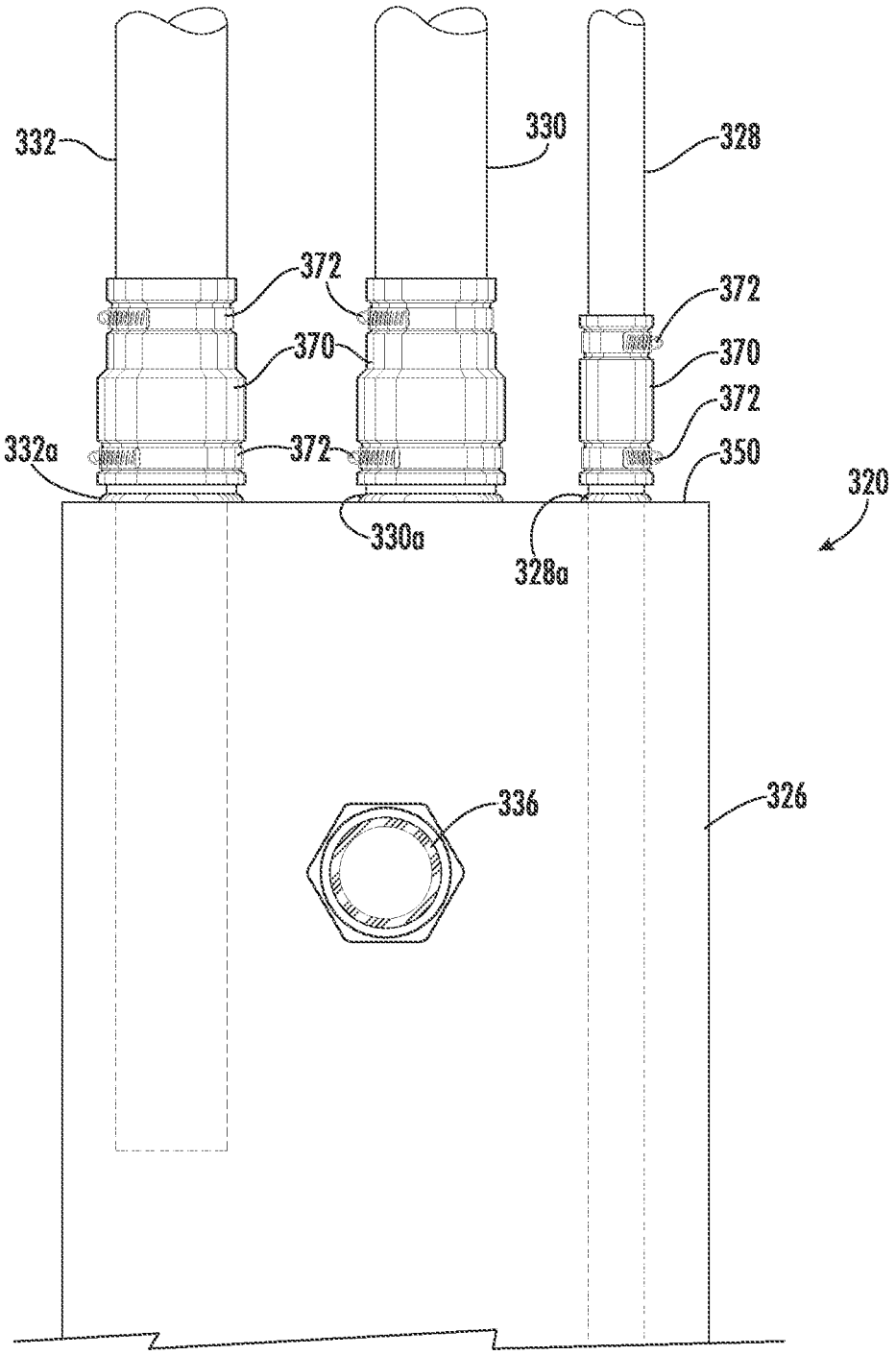
FIG. 18 is a front partial close-up view of a fourth embodiment.
Figure 19:
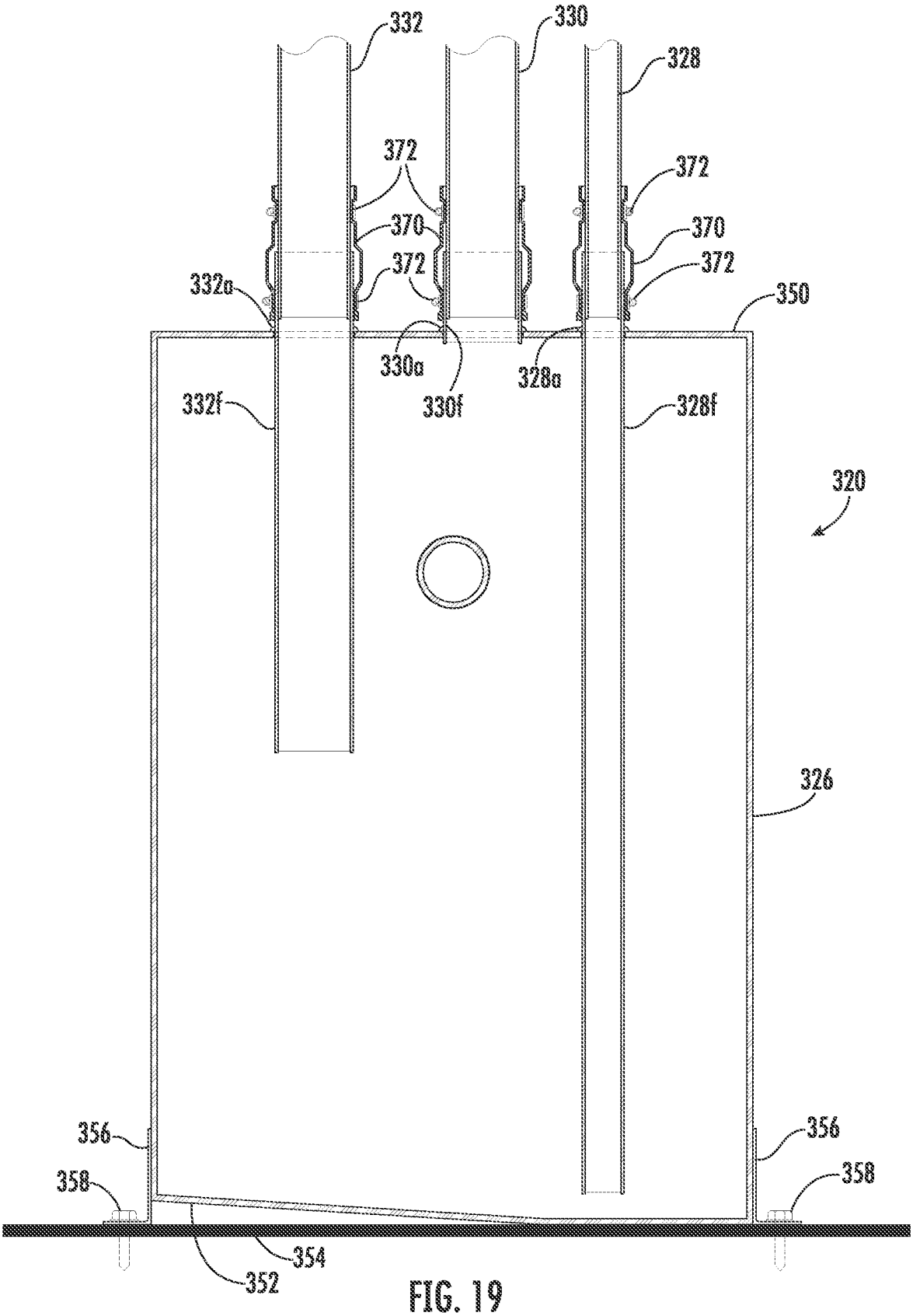
FIG. 19 is a partial-sectional close-up view of the fourth embodiment.

Four examples of assemblies will now be discussed in turn, in view of the general system description above using a rigid, self-supporting vacuum plumbing assembly for attaching a plumbing fixture to a vacuum-assist waste removal system. FIGS. 1-8 show a first embodiment, FIGS. 9-12 show a second embodiment, FIGS. 13-17 show a third embodiment, and FIGS. 18 and 19 show a fourth embodiment.

FIGS. 1-8 show aspects of a rigid self-supporting vacuum plumbing assembly 20 for attaching a plumbing fixture 22 to a vacuum-assist waste removal system 24. Assembly 20 includes an accumulator 26, as well as a wastewater outlet conduit 28, an air intake conduit 30, and a sensor conduit 32, all configured with the accumulator as a unit to form the assembly. Assembly 20 is rigid, and is sufficiently self-supporting to be lifted, moved, transported, installed, etc., in a peripherally frameless configuration, contrasted with other frame-based systems where support is provided by an external, steel-channel based frame. In other aspects, such an assembly may include additional or other elements, but the elements above allow suctioning with air intake and control functions for wastewater accumulating in the accumulator.

Accumulator 26 is a vessel for capturing and storing wastewater from a plumbing fixture 22, such as the depicted sink 34. Accumulator 26 may be a metal or plastic box or other shaped vessel having an inlet 36 for receiving water that runs out of the plumbing fixture, such as the through a conventional drain piping 38 (metal or PVC), such as the depicted drain and sink trap. Inlet 36 may attach to drain piping 38 via a short pipe section 40 configured, for example, with threading or other connection structure, to matingly receive and attach to the drain piping, although any waterproof permanent or removable method of attachment is possible. As illustrated, accumulator 26 is a metal box of about 18 gallons, formed of stainless steel plates, with dimensions of 2¼ inches (width W), by about 14 inches (length L) and about 18 inches (height H).

Other sizes, shapes, constructions, etc., could be employed based on the desired location, application, type, or number of fixtures served, etc. For example, the volume could be maintained but the accumulator resized by altering two of more of the three dimensions. Also, the volume could be altered by modifying at least one of the dimensions. The 2¼ width accumulator has particular utility as a "slim-fit" design that is readily able to be fit within conventional walls and may be able to be fit within walls that wider conventional accumulators, connectors, and frames do not.

Wastewater outlet conduit 28 may be for example a ½ inch to 1 inch pipe suitable for suctioning of wastewater from accumulator 26. Air intake conduit 30 and sensor conduit 32 may if desired be larger, such as 1½. To maintain a slimmer profile for the assembly, two of such 1½ inch air intake conduits could be employed, rather than upsizing the one air intake conduit and thereby requiring a wider accumulator or attachment hardware.

Figure 2:
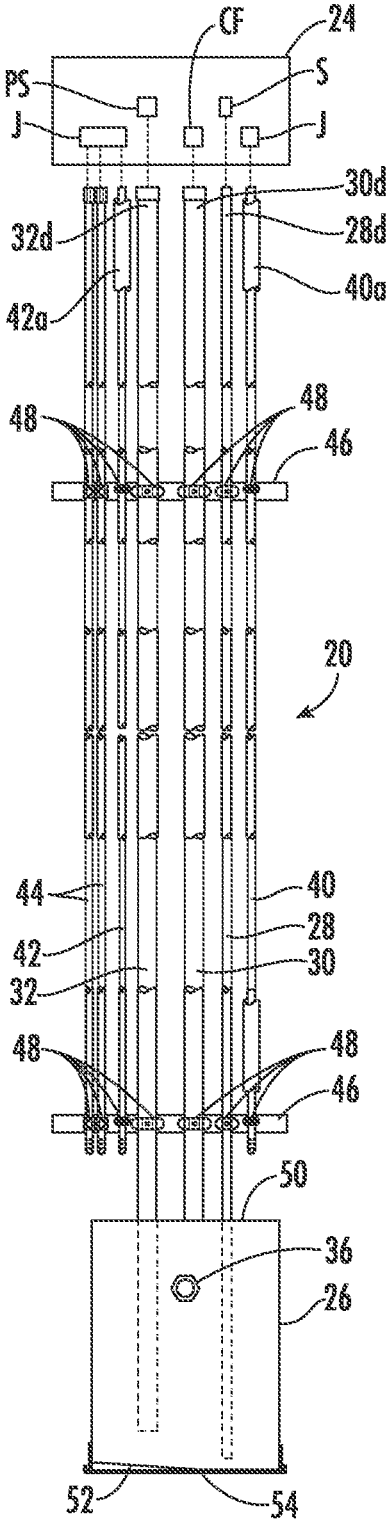
FIG. 2 is a front view as in FIG. 1, with additional supply lines attached via supply line cross-bracing.
Figure 3:
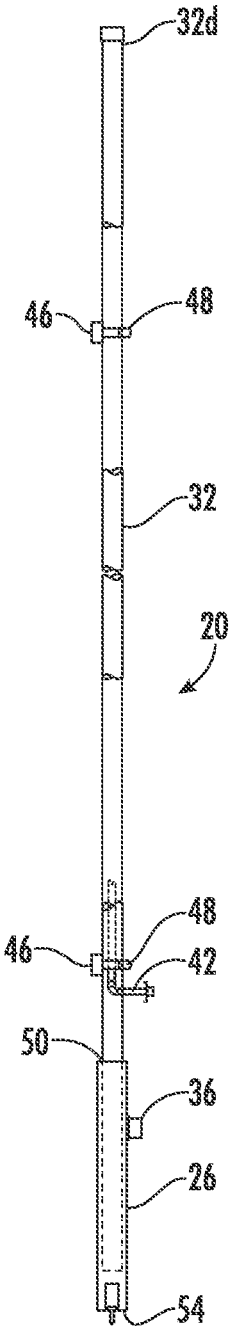
FIG. 3 is a side view as in FIG. 2.
Figure 4:
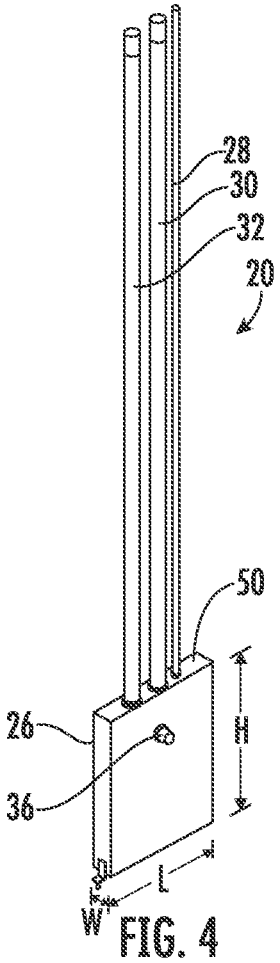
FIG. 4 is an isometric view as in FIG. 1.
Figure 5:
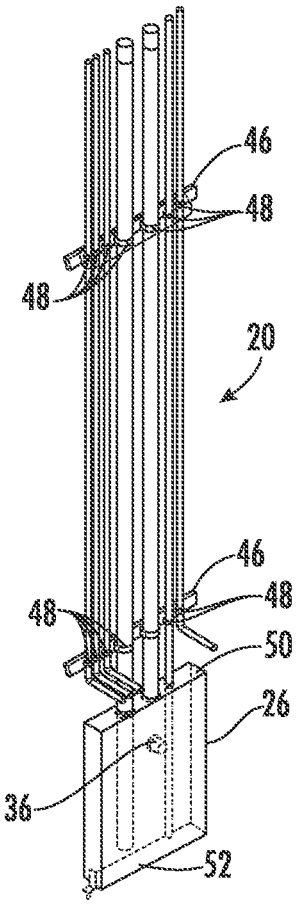
FIG. 5 is an isometric view as in FIG. 2.

As shown in FIG. 2, if desired for a given application such as a sink, conduits for cold water supply 40, hot water supply 42, and other purposes 44 may also be included, but not attached directly to accumulator 26. The optional, other purpose conduits 44 may be provided for providing electrical signaling, sensing, or switching, or an additional liquid or gas supply, sterilization functions, or other functions as desired connected to system 24 at respective junctions J. These optional conduits may if desired be smaller, in the range of ½ inch, and may be attached to conduits 28, 30, and 32 by cross-bracing 46 and clamps 48, which may be stand-alone items as shown in FIG. 2 or which may be components of a modular wall system. The cross-bracing 46 may be flush-mount Unistrut or other extrusions or molded or otherwise crafter items, that add minimal if any overall thickness to the accumulator system beyond that of the accumulator. Insulation 40*a*, 42*a* may be provided for water supply conduits.

Figure 8:
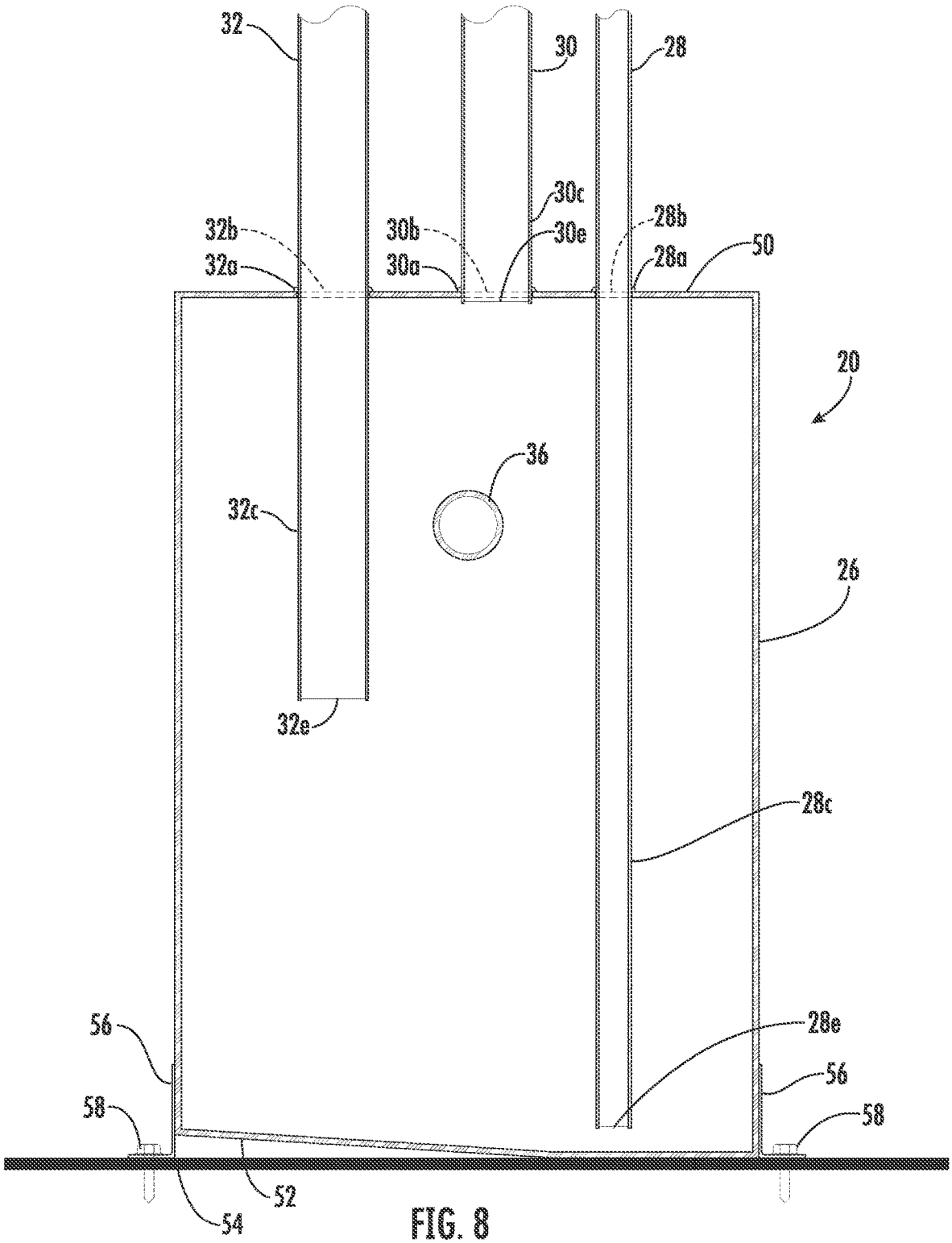
FIG. 8 is a partial sectional close-up view showing the connection of the conduits to the accumulator.
Figure 9:
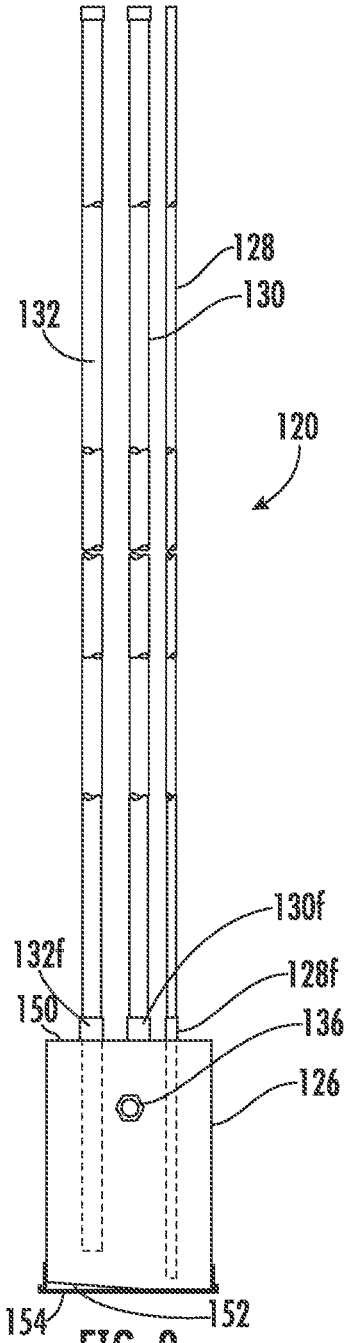
FIG. 9 is a front view of a second embodiment with sleeves for assisting in attaching the conduits.
Figure 10:
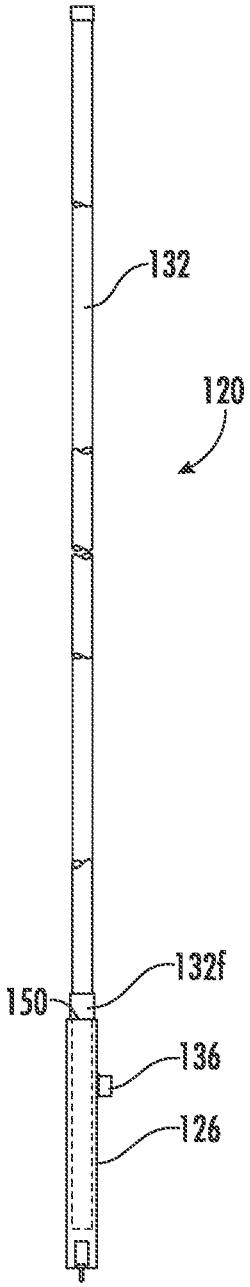
FIG. 10 is a side view of the second embodiment.
Figure 11:
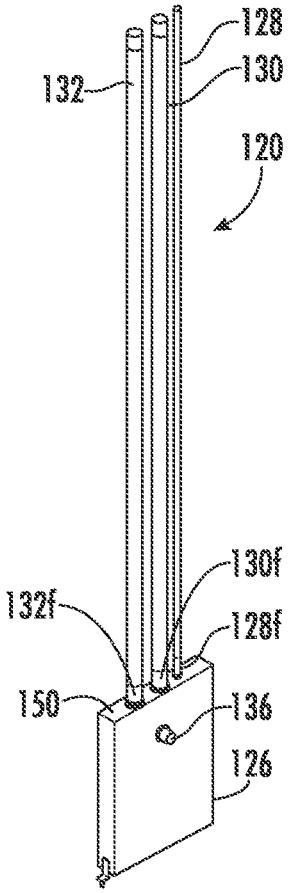
FIG. 11 is an isometric view of the second embodiment.
Figure 12:
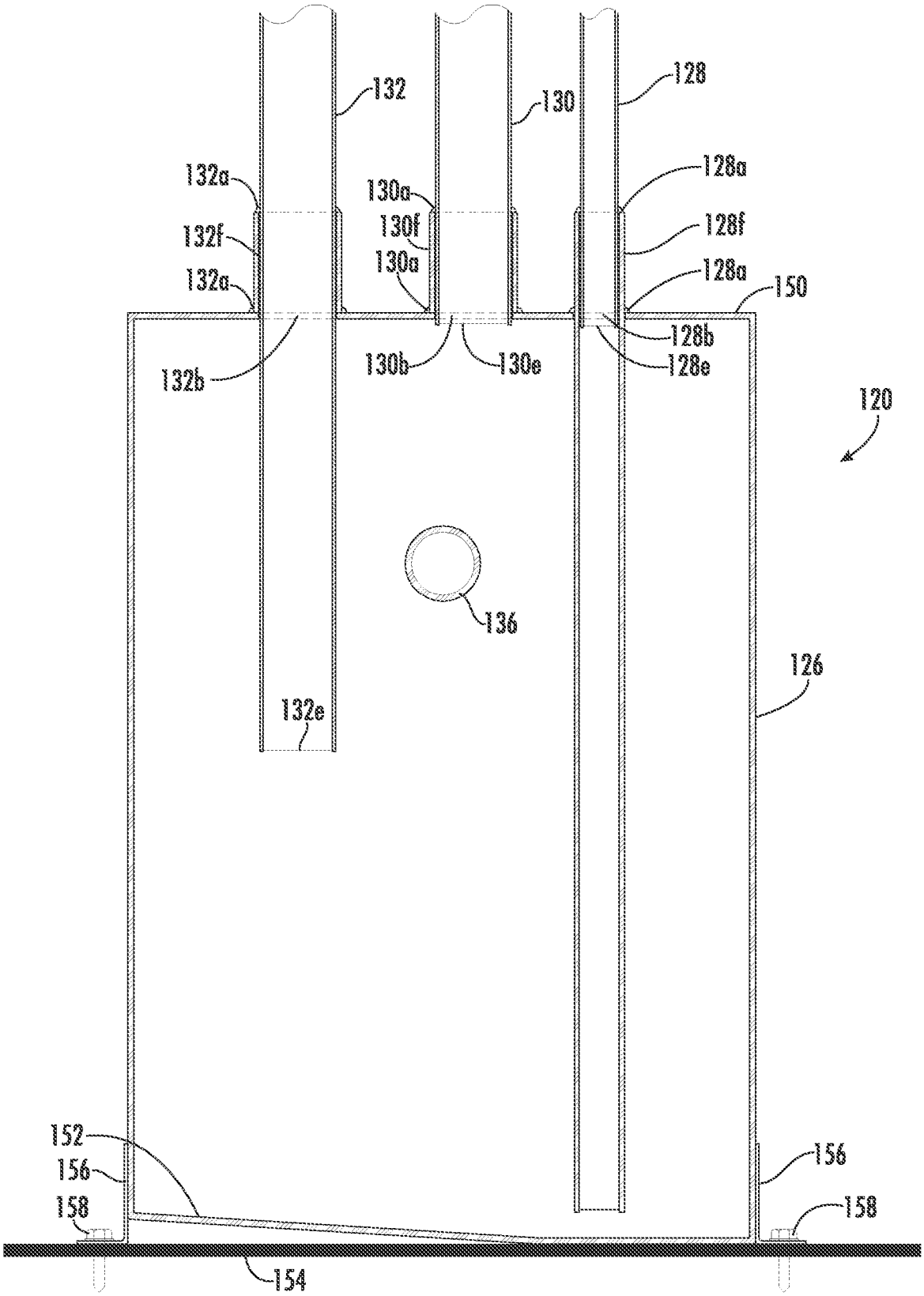
FIG. 12 is a partial-sectional close-up view of the second embodiment.
Figure 13:
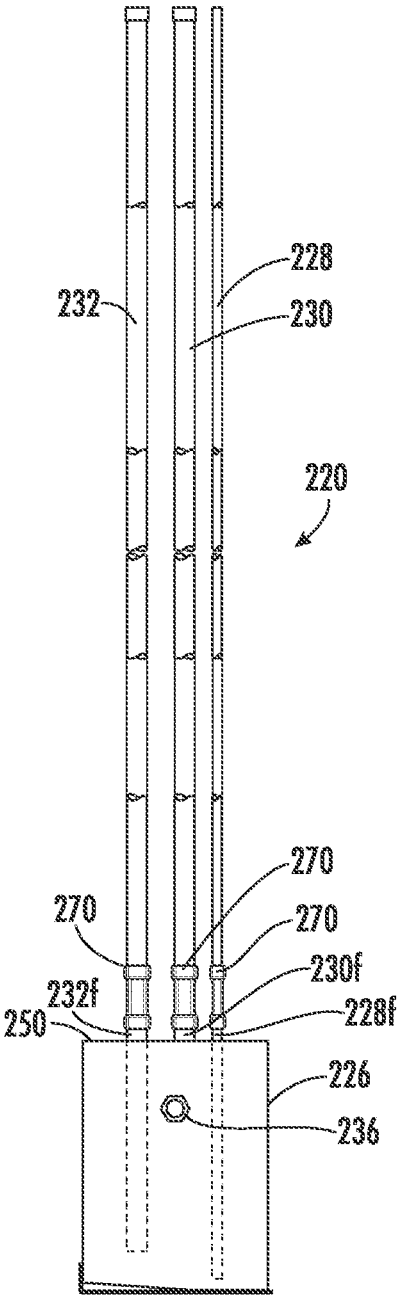
FIG. 13 is a front view of a third embodiment compression fittings for assisting in attaching the conduits.
Figure 14:
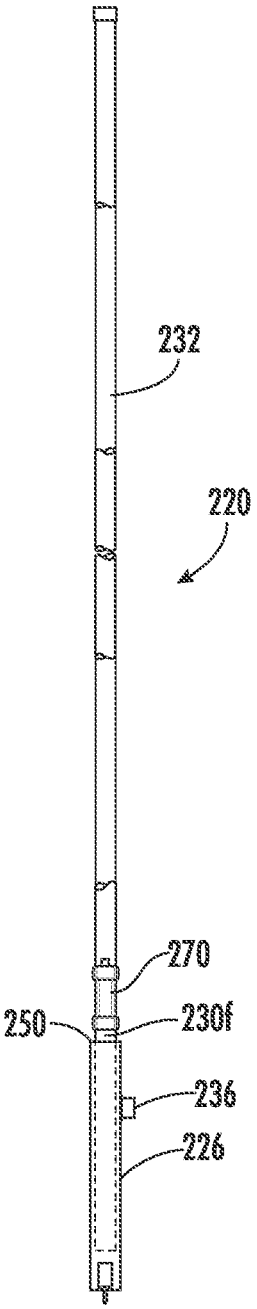
FIG. 14 is a side view of the third embodiment.
Figure 15:
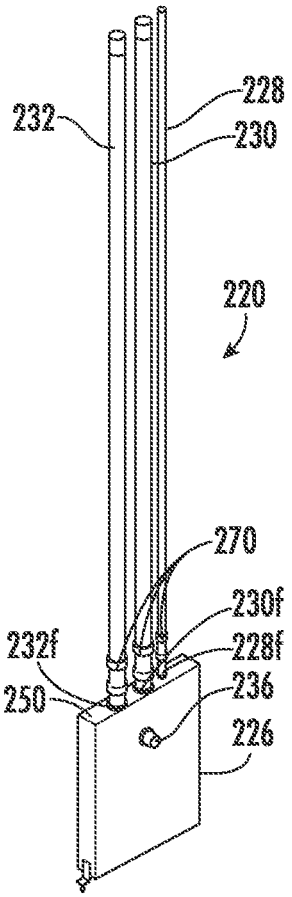
FIG. 15 is an isometric view of the third embodiment.
Figure 16:
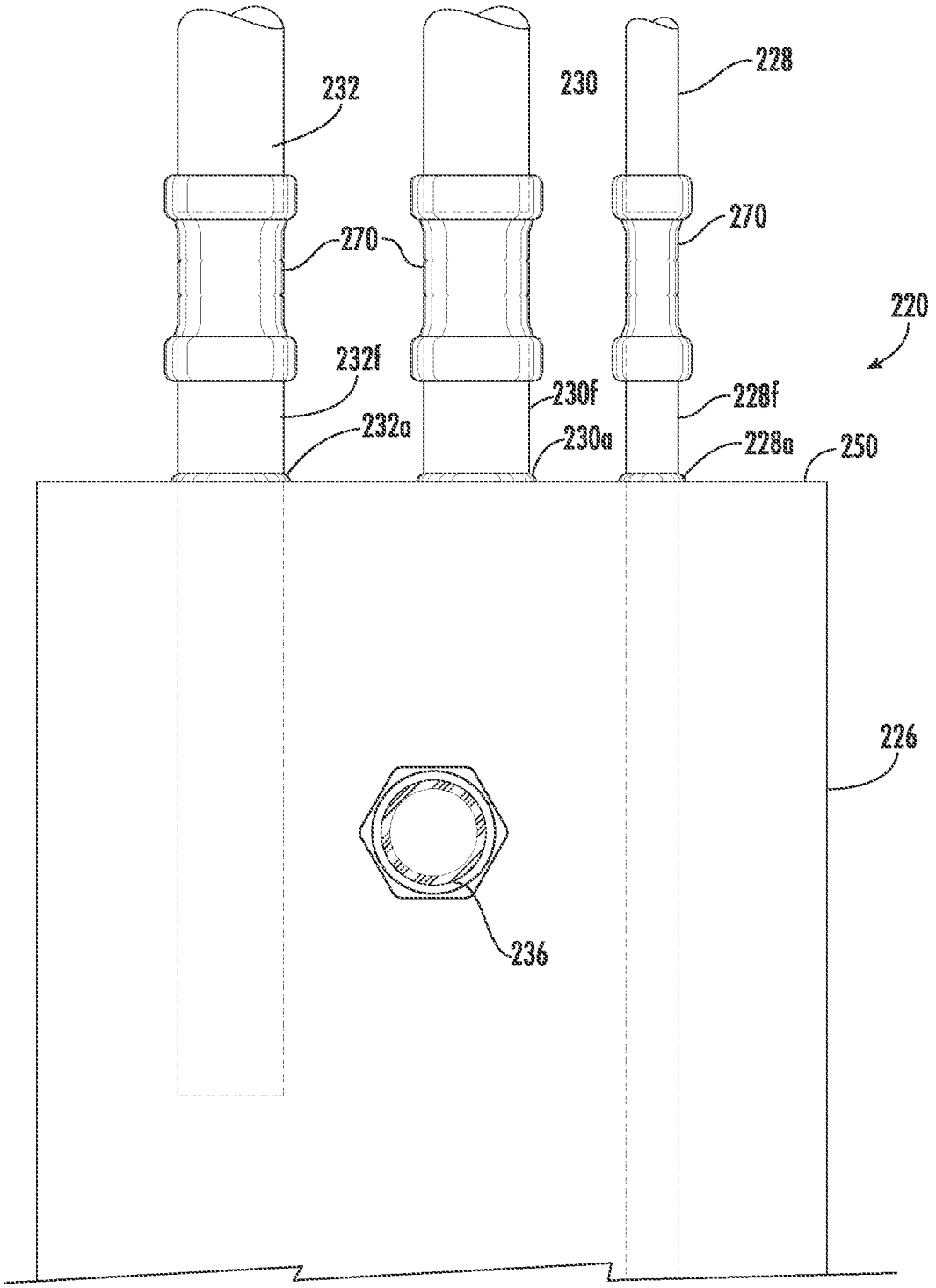
FIG. 16 is a front partial close-up view of the third embodiment.
Figure 17:
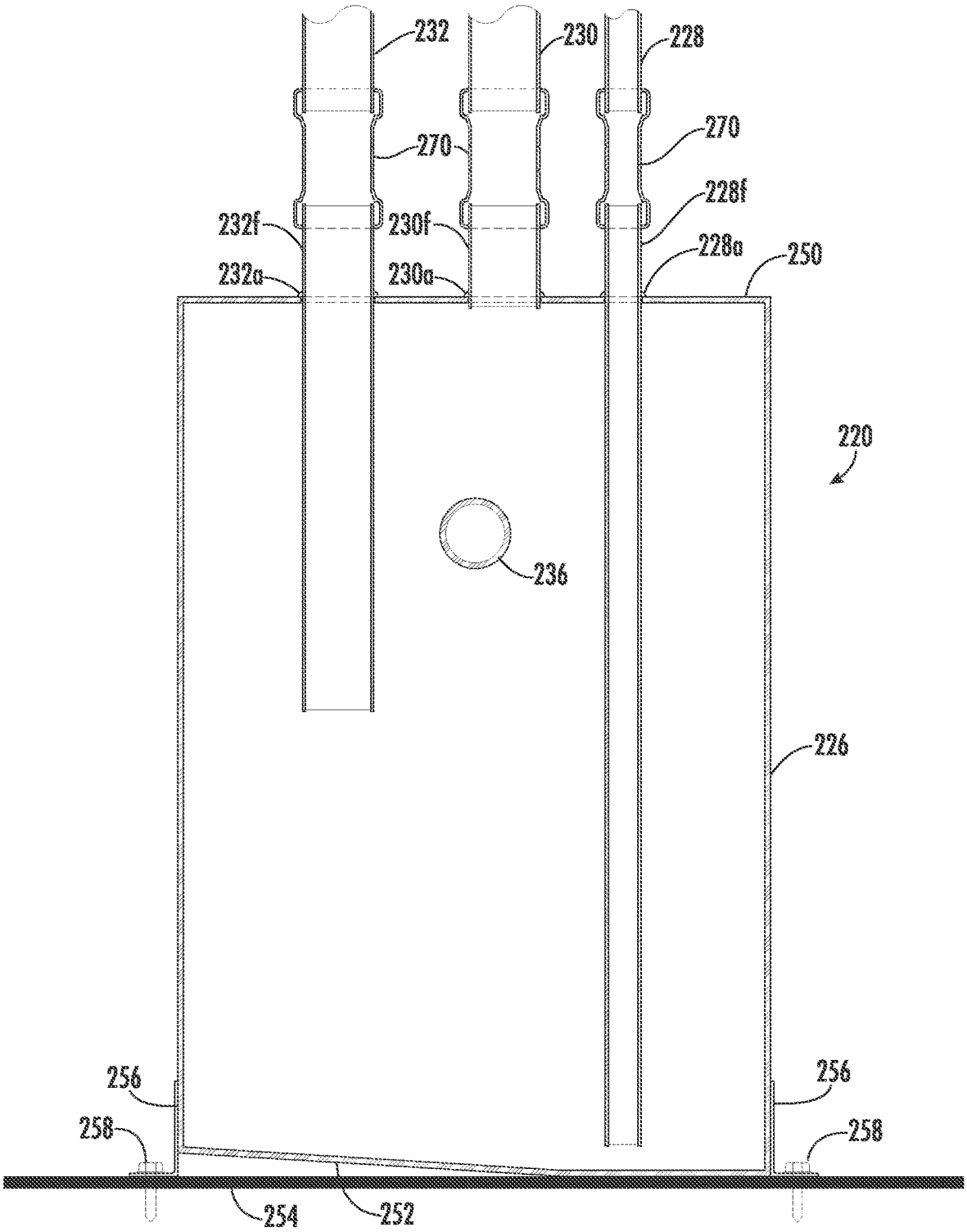
FIG. 17 is a partial-sectional close-up view of the third embodiment.

If accumulator 26 is metallic, conduits 28, 30, and 32 may also be metallic and rigidly attached to the accumulator via welds 28*a*, 30*a*, and 32*a* at openings 28*b*, 30*b*, and 32*b* in top wall 50 of accumulator 26 (see FIG. 8). If accumulator 26 is plastic, these conduits may also be plastic (PVC), and the welds may be replaced by a suitable rigid connection via PVC adhesive, epoxy, glue, etc. First ends 28*c*, 30*c*, and 32*c* are thus attached to the accumulator 26, whereas second ends 28*d*, 30*d*, 32*d* extend upward to attach to the vacuum-assist waste removal system. A charcoal filter CF may be present on air intake conduit 30 or part of the vacuum-assist waster removal system to take up and back gasses generated while the system is not actively pumping waste.

The first ends 28*c*, 30*c*, and 32*c* may extend different lengths into accumulator 26. For example, wastewater outlet conduit 28 may extend into accumulator so an opening 28*e* of the conduit is situated near a bottom wall 52 of accumulator 26 to facilitate substantial emptying of the accumulator via suction without clogging opening 28*e*. If desired bottom wall may be configured to slant toward opening 28*e* to collect and facilitate suctioning of wastewater through end 28*c*. Air intake conduit 30 need only extend a small way into accumulator, so its opening 30*e* may be near top wall 50. Sensor conduit 32 may extend into accumulator 26, preferably with opening 32*e* at a height below that of inlet 36. Sensor conduit 32 can be connected at its open end to a pressure sensing device PS so that when water level within accumulator 26 reaches and thereby closes opening 32*e* a signal is generated by the sensor, indicating the vacuum-assist waste removal system section device S should operate to drain accumulator 26.

Figure 6:
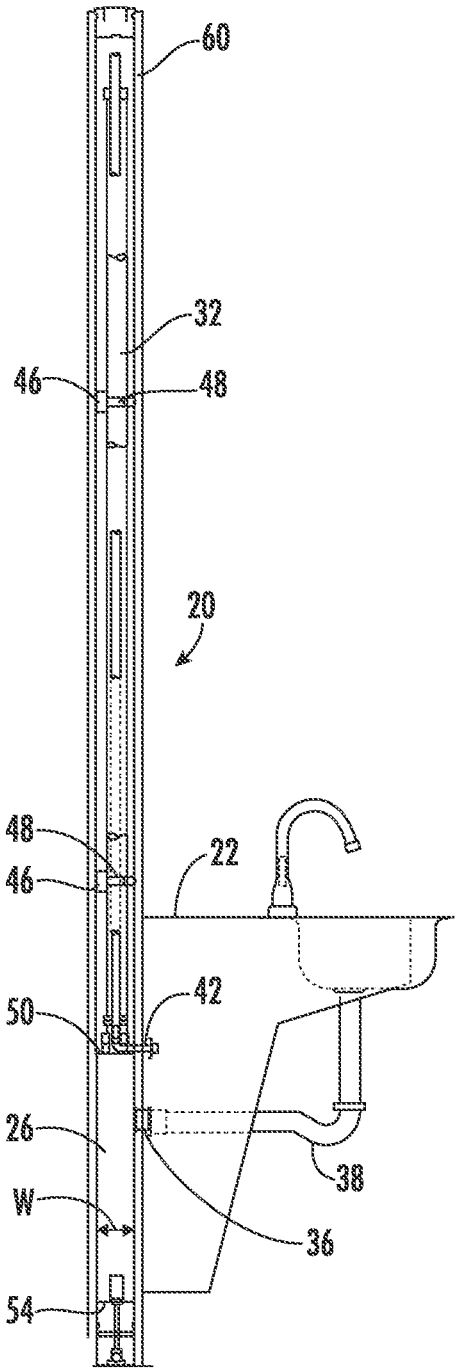
FIG. 6 is a side view as in FIG. 2, showing the assembly further attached to a fixture and a vacuum pluming system and a supply.
Figure 7:
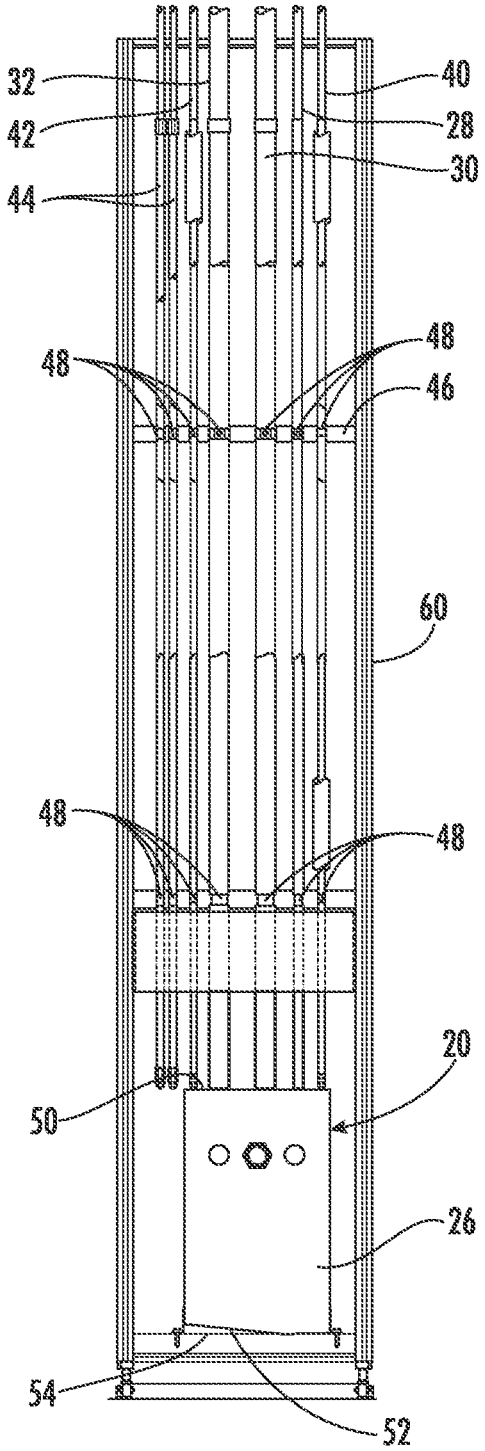
FIG. 7 is a front view as in FIG. 2, showing the assembly within a modular wall unit.

Accumulator 26 may be attached to a lower surface 54 by hardware, such as flanges 56 and screws 58 (as shown), or glue or adhesive, etc. Lower surface 54 may be a floor or may be a surface within a wall or a modular wall (as shown in FIGS. 6 and 7). Assembly 20 may be held in place by other structures and bottom wall 52 may simply sit on whatever lower surface 54 is present without attachment at that location.

Assembly 20 may be formed of a monolithic (molded plastic such as PVC, if desired, rather than being assembled from parts 26, 28, 30, and 32. Such construction provided even more efficiency in manufacturing while still provided the benefits of a rigid shipping and installation ready structure.

Regardless of the options used, assembly 20 provides a simplified construction useful for installing vacuum-assist plumbing assemblies. The simplified structure is rigid enough to avoid use of a frame for manufacturing, shipping, or installation purposes. Thus, efficiencies are achieved. Also, the simplified structure of sliding conduits 28, 30, and 32 into openings 28*b*, 30*b*, and 32*b* in top wall 50 and sealing there with a weld or the like allows a slim profile that may be desirable in some applications. In particular, the width of the assembly 20 need not be any more than the width W of accumulator 26 (see FIG. 6), making placement of assembly 20 within walls easier, and particularly easier within premanufactured module walls. Accumulator 26 may therefore have a width in the range of less than 3½ inches, and may be as low as about 2¼ inches, easily filling within conventional stick built or modular walls. A "slim-fit" thickness of 2¼ inches is particularly suitable for many modular walls and may be achieved with connected conduits up to about 1½ inches and up to 2¾ inches with conduits up to about 2 inches in diameter. Assembly 20 can therefore be specified as a standardized optional addition for stick built or modular walls, and a premanufactured assembly can be installed either as the wall is manufactured or as it is installed.

FIGS. 9-12 show a slightly modified assembly 120 wherein connection between conduits entering the accumulator and the accumulator is changed. Otherwise, other elements are similar and features common to the above embodiment will not be discussed again for brevity herein.

As shown in FIGS. 9-12, accumulator 126 is attached to wastewater outlet, air intake, and sensor conduits 128, 130, and 132 via sleeves 128*f*, 130*f*, and 132*f*. The sleeves as shown have differing lengths, but such may be modified in each case. Sleeves 130*f* and 132*f* are annular and sit atop top wall 150. Conduits 130 and 132 extend though sleeves 130*f* and 132*f* into accumulator 126 as in the above embodiment Welds 130*a* and 132*a* are made at each end of sleeves 130*f* and 132*f* to hold the sleeves, the conduits, and the accumulator together in one piece. Sleeve 132*f* extends through top wall 150 to the desired depth of suctioning within accumulator 126, and conduit 128 extends only part of the way into sleeve 128*f*. Welds 128*a* are present to attach sleeve 128*f* to accumulator 126 and conduit 128. It should be understood that sleeve 128*f* could be sized like sleeve 130*f* and conduit 128 extended further into accumulator 126 instead of sleeve 128*f*. Also, sleeve 132*f* could be made similar to sleeve 128*f* so that sleeve 132*f* and not conduit 132 extends into accumulator 126. As above, welds can be replaced by epoxy, glue, adhesive, or mating threaded connections.

Use of sleeves provides additional rigidity to assembly 120 while still maintaining a slim assembly and highly simplified assembly, without requiring certain conventional plumbing connectors. The slim-fit sizes of 2¼ and 2¾ inches noted above are still possible with this embodiment, although accumulator 126 could be made ¼ to ½ inch wider to accommodate the sleeves.

FIGS. 13-17 show another embodiment (assembly 220) that differs from previous embodiments (assemblies 20 and 120) in terms of connection between the three main conduits and the accumulator. In assembly 220, sleeves 228*f*, 230*f*, and 232*f* all extend through top wall 250 into accumulator 226. Welds 128*a*, 130*a*, and 132*a* are used to attach the sleeves to the accumulator. Conduits 228, 230, and 232 have ends 228*c*, 230*c*, and 232*c* above the sleeves and are attached thereto via a coupling 270, such as a non-overlapping, press-fit coupling, for example a conventional Viega Pro-Press® type metallic coupling. While the use of a rigid non-overlapping coupling 270 (press-fit or other) adds some width and complexity to the overall assembly as compared to previous embodiments, use of such allows the accumulator and sleeves to be premanufactured in a first step, then then conduits can be attached in a second step, which may be useful in terms of manufacturing or shipping efficiency, whereas the resulting assembly retains its rigidity. The addition of the couplings may make assembly 220 overall wider if a 2¼ inch width or even wider (e.g., 2¾, 2⅞, etc.) accumulator is being used. If desired, accumulator 226 may be widened to the width of the couplings employed for further accumulation or different dimensioning of the accumulator.

FIGS. 18 and 19 show a fourth embodiment (assembly 320) with sleeves extending into the accumulator as in assembly 220, but with a different coupling structure. In assembly 220, sleeves 328*f*, 330*f*, and 332*f* also extend though top wall 350. However, a conventional overlapping flexible (rubber boot) coupling 370 is used, held in place by two clamps 372. Although the flexible coupling 370 is not rigid, the clamps and overlap of conduits 328, 330, and 332 with sleeves 328*f*, 330*f*, and 332*f* provides a desired rigidity. Couplings 370 and clamps 372, as well as the conduit/sleeve overlap, again may add a bit to the overall device thickness as compared to earlier embodiments, but the overall concept of a slim-fit assembly that is rigid and frameless upon construction is still achieved by assembly 320.

The above examples of self-supporting assemblies for attaching plumbing fixtures to a water supply system and to a vacuum-assist waste removal system thus provide various benefits. It should be understood that aspects of the above examples can be combined in different ways to achieve still further examples. All such variations are within the scope of the present disclosure, as defined by the appended claims.

I claim:

1. A vacuum plumbing assembly for attaching a plumbing fixture to a water supply and a vacuum-assist waste removal system, the assembly comprising:

a premanufactured, self-supporting accumulator assembly including:

a. an accumulator associated with the plumbing fixture for receiving and holding wastewater from the plumbing fixture, a wastewater inlet opening being defined in the accumulator for receiving the wastewater from the plumbing fixture;

b. a wastewater outlet conduit having a first end rigidly attached to the accumulator and a second end configured for attachment to the vacuum-assist waste removal system, the wastewater outlet conduit being configured for directing wastewater from the accumulator to the vacuum-assist waste removal system;

c. an air intake conduit having a first end rigidly attached to the accumulator and a second end spaced from the first end, the air intake conduit being configured for allowing flow of air into the accumulator through the air intake conduit when the vacuum-assist waste removal system is removing wastewater from the accumulator through the wastewater outlet conduit; and d. a sensor conduit having a first end rigidly attached to the accumulator and a second end spaced from the first end, the sensor conduit configured for at least assisting in at least one of generating a signal and relaying a signal when a level of the wastewater in the accumulator reaches a predetermined level, the signal indicating that the vacuum-assist waste removal system should remove the wastewater from the accumulator by applying suction to the second end of the wastewater outlet conduit;

wherein the wastewater outlet conduit, the air intake conduit, and the sensor conduit extend substantially parallel to one another from their respective first ends to their respective second ends, and are configured with the accumulator as a unit that is premanufactured, the unit being substantially rigid and sufficiently self-supporting to be transportable in a peripherally frameless configuration; and at least one supply conduit having a first end attachable to the water supply and a second end attachable to the fixture for supplying water to the fixture, the at least one supply conduit being spaced from and in non-contact with the accumulator; and at least one brace framelessly attaching the at least one supply conduit to at least one of the wastewater outlet conduit, the air intake conduit, and the sensor conduit while maintaining the peripherally frameless configuration of the unit so that the wastewater outlet conduit, the air intake conduit, the sensor conduit, and the at least one supply conduit extend substantially vertically when the vacuum plumbing assembly is installed to functionally connect the plumbing fixture, the water supply, and the vacuum-assist waste removal system.

2. The vacuum plumbing assembly of claim 1, wherein the accumulator is a container having a bottom, sides, and a top defining an interior volume for holding the wastewater.

3. The vacuum plumbing assembly of claim 2, wherein the sensor conduit includes a tube extending into the interior volume of the container, the first end of the sensor conduit located at a height within the container so that when the wastewater in the container reaches the predetermined level the signal is generated.

4. The vacuum plumbing assembly of claim 2, wherein each of the wastewater outlet conduit, the air intake conduit, and the sensor conduit communicate with the interior of the container through the top of the container.

5. The vacuum plumbing assembly of claim 1, further including a wastewater conduit in communication with the wastewater inlet opening, the wastewater conduit receiving wastewater from at least one fixture.

6. The vacuum plumbing assembly of claim 1, wherein at least one of the wastewater outlet conduit, the air intake conduit, and the sensor conduit is attached directly to the accumulator.

7. The vacuum plumbing assembly of claim 1, wherein the at least one of the wastewater outlet conduit, the air intake conduit, and the sensor conduit is attached to the accumulator by at least one of welding, gluing, threading, and clamping.

8. The vacuum plumbing assembly of claim 1, further including at least one sleeve fixedly attached to the accumulator, and wherein one of the wastewater outlet conduit, the air intake conduit, and the sensor conduit extends at least into the sleeve and is attached thereto or includes the sleeve.

9. The vacuum plumbing assembly of claim 8, wherein the one of the wastewater outlet conduit, the air intake conduit, and the sensor conduit extends through the sleeve and is attached to the sleeve by at least one of welding, gluing, threading, and clamping.

10. The vacuum plumbing assembly of claim 8, including a plurality of the sleeves and wherein each of the wastewater outlet conduit, the air intake conduit, and the sensor conduit is attached to a respective one of the sleeves.

11. The vacuum plumbing assembly of claim 1, wherein the accumulator has a width of no more than 2⅞ inches.

12. The vacuum plumbing assembly of claim 1, wherein the accumulator has a width of about 2¼ inches.

13. The vacuum plumbing assembly of claim 1, wherein at least one of the wastewater outlet conduit, the air intake conduit, and the sensor conduit includes a pipe made of a pipe having a 1½ inch outer diameter.

14. A plumbing fixture installation comprising the vacuum plumbing assembly as in claim 1, and further including the plumbing fixture, the plumbing fixture having an outlet communicatively attached to the wastewater inlet opening of the accumulator so that wastewater from the plumbing fixture is transmitted to the accumulator.

15. The plumbing fixture installation of claim 14, the plumbing fixture installation further including a wall having two wall surfaces defining a cavity therebetween, the fixture being mounted on an outer side of one of the wall surfaces and the vacuum plumbing assembly being mounted in the cavity between the two wall surfaces.

16. The plumbing fixture installation of claim 15, wherein the wall is a modular wall, the modular wall being a prefabricated structure.

17. The plumbing fixture installation of claim 16, wherein the accumulator is a container having a bottom, sides, and a top defining an interior volume for holding the wastewater, the bottom of the container being configured for engagement with a lower surface of the cavity within the modular wall.

18. The plumbing fixture installation of claim 15, wherein the cavity has a width between the two wall surfaces of no greater than 2⅞ inches.

19. The plumbing fixture installation of claim 18, wherein the vacuum plumbing assembly has a width of from ¼ to ½ inches less than the width of the cavity so that the assembly fits within the cavity.

20. The plumbing fixture installation of claim 14, further including the water supply.

21. The plumbing fixture installation of claim 14, further including the vacuum-assist waste removal system.

22. The plumbing fixture installation of claim 21, further including the water supply.

* * * * *